US005667324A

United States Patent [19]

Aoki

[11] Patent Number: 5,667,324

[45] Date of Patent: Sep. 16, 1997

[54] BINDERS

[75] Inventor: Yasuo Aoki, Tokyo, Japan

[73] Assignee: Motohiro Kurauchi, Kanagawa-Ken, Japan

[21] Appl. No.: 296,782

[22] Filed: Aug. 26, 1994

[30] Foreign Application Priority Data

Aug. 27, 1993 [JP] Japan ..... 5-051440

[51] Int. Cl.[6] ..... B42F 3/02

[52] U.S. Cl. ..... 402/46; 402/56; 402/39

[58] Field of Search ..... 402/36, 37, 38, 402/39, 40, 41, 55, 56, 46, 20

[56] References Cited

U.S. PATENT DOCUMENTS

| | | | |
|---|---|---|---|
| 2,644,456 | 7/1953 | Marsh | 402/46 |
| 2,664,897 | 1/1954 | Derringer | 402/39 |
| 3,077,888 | 2/1963 | Thieme | 402/39 X |
| 3,833,308 | 9/1974 | Seaborn | 402/56 |
| 5,018,896 | 5/1991 | Vanni | 402/39 X |

FOREIGN PATENT DOCUMENTS

| | | | |
|---|---|---|---|
| 582159 | 5/1924 | France | 402/56 |
| 57-3820 | 1/1982 | Japan . | |

*Primary Examiner*—Willmon Fridie, Jr.

*Attorney, Agent, or Firm*—Seidel, Gonda, Lavorgna & Monaco, PC

[57] ABSTRACT

A loose-leaf binder comprising, in combination, a first back strip having a plurality of split ring halves formed upright at given intervals along the outer edge thereof and a second back strip having similar ring halves formed along the outer edge thereof opposite to that of the first strip and adapted to engage end to end with the halves of the first strip. The first and second back strips are formed as discrete members separable from the combined state and have first and second lock members, respectively, at the both ends thereof in such manner that the lock members can engage with each other when the two strips are put together in the closed position. The two back strips also have, respectively, a first and a second sliding surfaces slidable relative to each other, and a first and a second guides extending substantially at right angles to the longitudinal directions of the two strips and formed to shapes complementary to each other so as to guide the sliding surfaces.

31 Claims, 11 Drawing Sheets

BINDERS

BACKGROUND OF THE INVENTION

This invention relates to binders of the type that holds a plurality of loose leaves perforated along one edge for binding and, more particularly, to binders for loose-leaf albums, notebooks, clear-film-pouch files, and the like.

Binders that hold loose leaves with split rings opened and closed are brought under two chief categories; binders having proper rings for simply holding loose leaves in book form and binders holding loose leaves and secured to the back of a hard cover with eyelets or rivets.

Typical of the former category is, as shown in FIG. 1, a coil spring-like binder 1 that spirals through perforations 5 formed at regular intervals along one edge of a number of loose leaves 3. A variation is a binder 9, shown in FIG. 2, having partly open, almost completely closed binding rings 7.

The latter category with a cover, as represented in FIG. 3, typically comprises a cover 21, an elastic inner cover 11 fixed to the cover, a pair of movable back strips 13, 15 constrained by the inner cover to mate together along the inner edges, binding ring halves 17, 19 provided on the back strips to come into engagement for complete ring formation, and levers 23, 25 with which the back strips are urged upward or downward to allow the ring halves 17, 19 to open or close the rings. Another binder, as shown in FIG. 4, has a fixed back strip 27 secured to the inner side of a hard cover with rivets 28 and a movable back strip 29 which is turned open or close relative to the fixed strip with a pivot 31 so as to open or close split ring halves 33, 35, keeping the rings closed by means of a fixed lock member 37 and a pivotally movable lock member 39.

Binders of the designs illustrated in FIGS. 1 and 2 do not easily bind loose leaves; they cost money and time for binding. Moreover, the loose leaves cannot or can hardly be removed.

The designs shown in FIGS. 3 and 4 open and close easily to facilitate the binding and replacement of loose leaves. However, the binder of FIG. 3 comprises so many parts that it is large in size and costly. The much exposed levers 23, 25 and the inner cover 11 make the binder too bulky in sectional contour for services as depicted in FIGS. 1 and 2. The binder shown in FIG. 4 is complex in mechanism since it has a pivotal connection at the far end where the pivot 31 is located and has the lock members 37, 39 at the near end. If it is used unbacked as in FIGS. 1 or 2, the lock members are exposed, marring the appearance of the binder aesthetically.

It is therefore an object of the present invention to provide a binder extremely simple in construction, good in appearance, and easy to handle in binding and removing loose leaves.

Another object of the invention is to provide a binder structure suited for both applications backed by a cover and unbacked.

SUMMARY OF THE INVENTION

In brief, the loose-leaf binder of the present invention comprises, in combination, a first back strip having a plurality of split ring halves formed upright at given intervals along the outer edge thereof and a second back strip having similar ring halves formed along the outer edge thereof opposite to that of the first strip and adapted to engage end to end with the halves of the first strip, and is characterized in that said first and second back strips are formed as discrete members separable from the combined state and have first and second lock members, respectively, at the both ends thereof in such manner that said lock members can engage with each other when the two strips are put together in the closed position.

In another aspect, the loose-leaf binder of the invention comprises, in combination, a first back strip having a plurality of split ring halves formed upright at given intervals along the outer edge thereof and a second back strip having similar ring halves formed along the outer edge thereof opposite to that of the first strip and adapted to engage end to end with the halves of the first strip, and is characterized in that said first and second back strips are formed as discrete members separable from the combined state and have, respectively, a first and a second sliding surfaces slidable relative to each other, a first and a second guides extending substantially at right angles to the longitudinal directions of the two strips and formed to shapes complementary to each other so as to guide the sliding surfaces, and a first and a second lock members in such manner that said lock members can engage with each other when the two strips are put together in the closed position.

Another feature of the invention is that either of the first and second back strips has an insertion flap and the other strip has a recess into which the insertion flap can be fitly inserted. This ensures exact alignment of the two back strips and therefore precise closing of the split rings. Moreover, the frictional forces of the engaging strips can be utilized in supplementing the forces with which the split rings are positively closed when the two strips are put together. It is further possible to form an upper flap and a lower flap on each back strip with a recess for insertion so that the upper or lower flap of each strip can be inserted into the corresponding recess of the opposite strip.

DETAILED DESCRIPTION OF THE INVENTION

In an embodiment of the invention, the first sliding surface is formed on the top of the first back strip and the second sliding surface on the bottom of the second back strip. Also, the first back strip has, as a first guide, a guide rib extending substantially at right angles to the longitudinal direction of the strip and parallelly in spaced relation with the first sliding surface, and the second back strip has, as a second guide, a guide slit which slidingly receives the guide rib for engagement. Thus, when the two back strips held separately on the left and right are to be put together, they are properly guided by the guiding action of the two sliding surfaces and the lock members or, where separate guides are used, by those guides to a closing position where their split ring halves can be properly closed as well.

The first lock member includes a hook protruding downwardly from each end of the first back strip and the second lock member includes a hook formed at each end of the second back strip to engage with said hook of the first strip. When guide faces are formed partially on the lock members, they permit the both back strips, when being put together, to be naturally guided to a proper position for engagement. The lock can be unfastened against the elasticity of the second lock member. The lock members, formed as part of the both back strips, can be made small enough to save space.

In a preferred embodiment, the first lock member may comprise a pair of first hooks arranged in tandem in the direction where the two back strips are put together or apart (caused to slide). This makes two-step locking possible. In the first lock position the split ring halves are completely closed, and in the second lock position they are split apart but their back strips are not disconnected yet. The two back strips can be separated off when necessary.

In another preferred embodiment the two back strips are provided, respectively, with a rib as a detent and a corresponding groove for mutual engagement at an intermediate point of the strips. This embodiment prevents split ring halves from being forced apart midway on long back strips.

According to the present invention, the first and second back strips are formed as discretely separate components and they can easily be put together by aligning the guides as well as the sliding surfaces and causing them to slide toward each other until the lock members are mutually engaged. This results in proper connection end to end of the split ring halves of the two back strips. The lock members can be readily disengaged upon depression with the thumb.

First Embodiment

Figure 1:
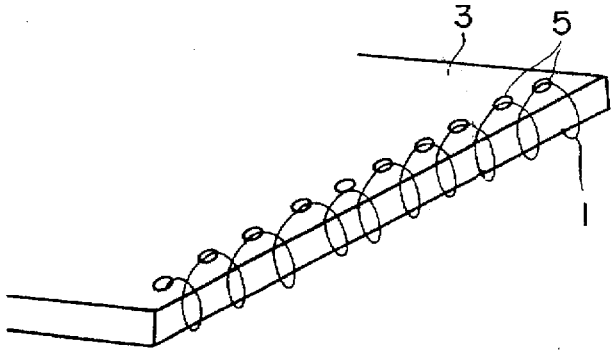
FIG. 1 Prior Art
FIG. 1 is a perspective view of a conventional unbacked binder.
Figure 2:
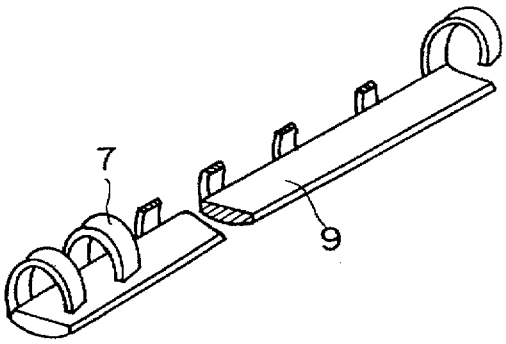
FIG. 2 Prior Art
FIG. 2 is a perspective view of another conventional unbacked binder.
Figure 3:
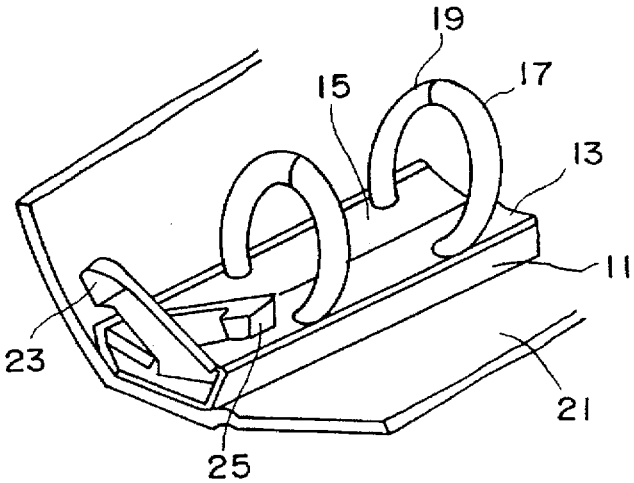
FIG. 3 Prior Art
FIG. 3 is a perspective view of a conventional binder of the type used with a back cover.
Figure 4:
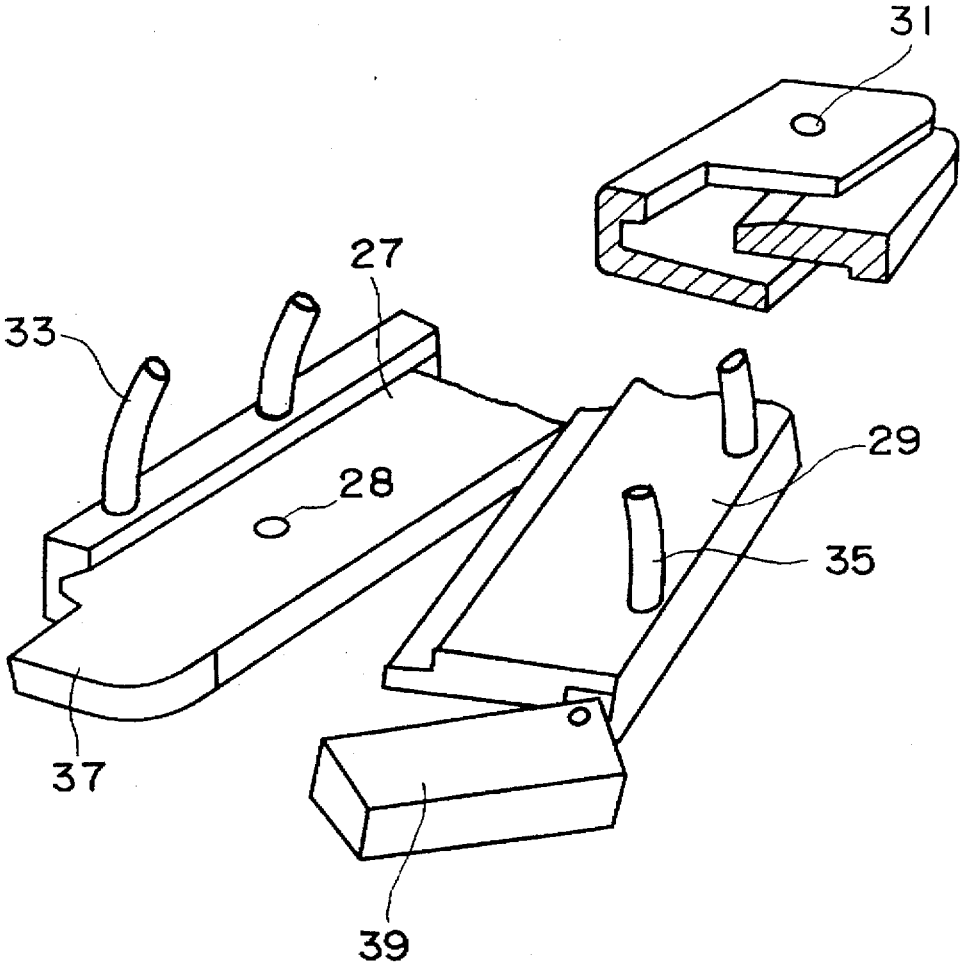
FIG. 4 Prior Art
FIG. 4 is a perspective view of another conventional binder of the type used with a back cover.
Figure 5:
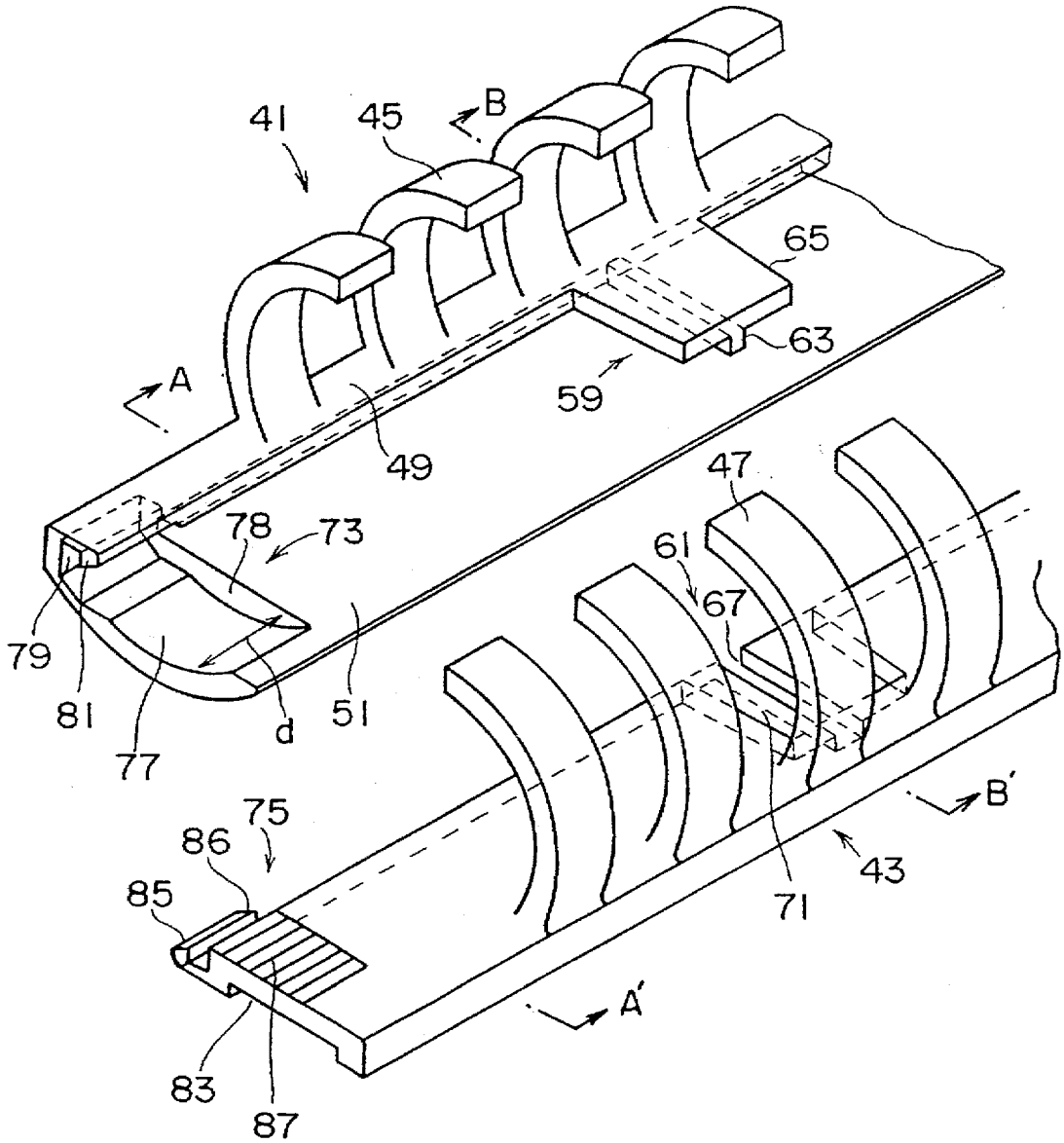
FIG. 5 is an enlarged perspective view of essential parts of the binder of the invention, as put together.
Figure 6:
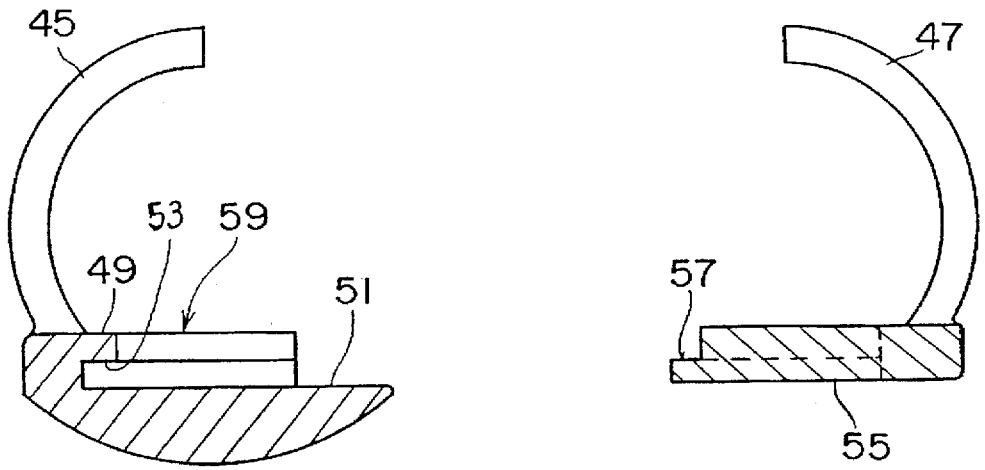
FIG. 6 is a sectional view taken along the line A-A' of FIG. 5.
Figure 7:
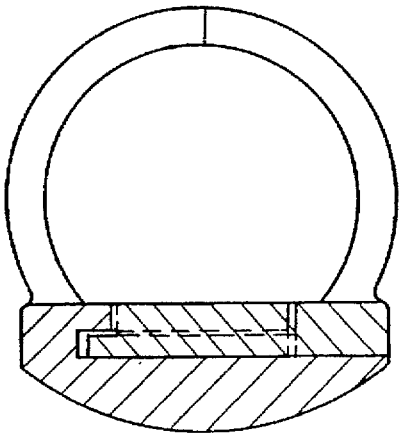
FIG. 7 is a sectional view of the parts on the line A-A' of FIG. 5, as engaged with each other.
Figure 8:
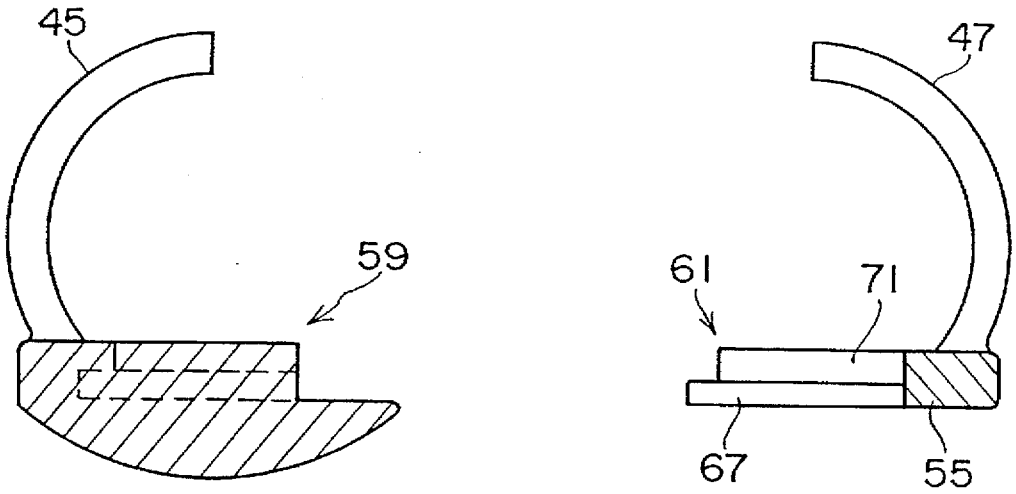
FIG. 8 is a sectional view taken along the line B-B' of FIG. 5.
Figure 9:
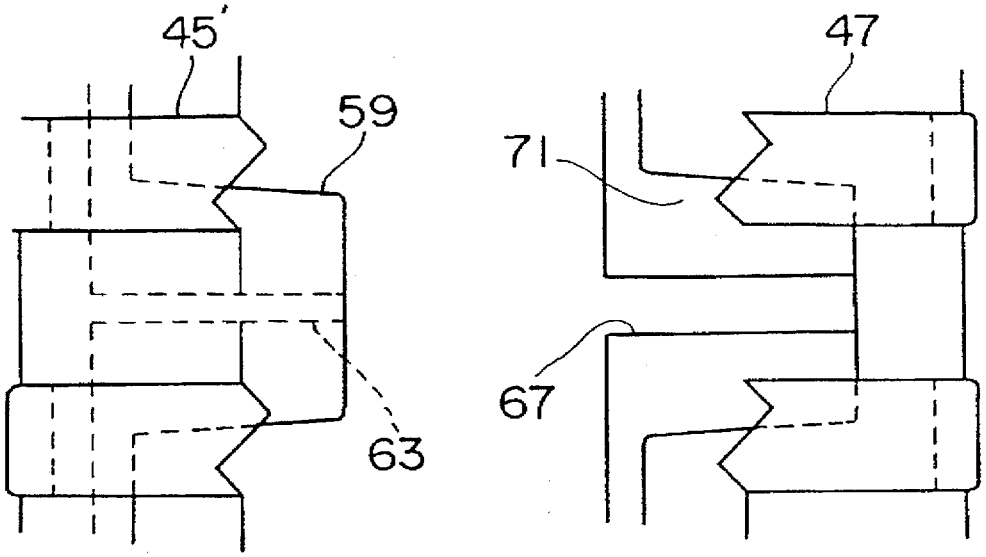
FIG. 9 is a plan view of guides according to this invention.
Figure 10:
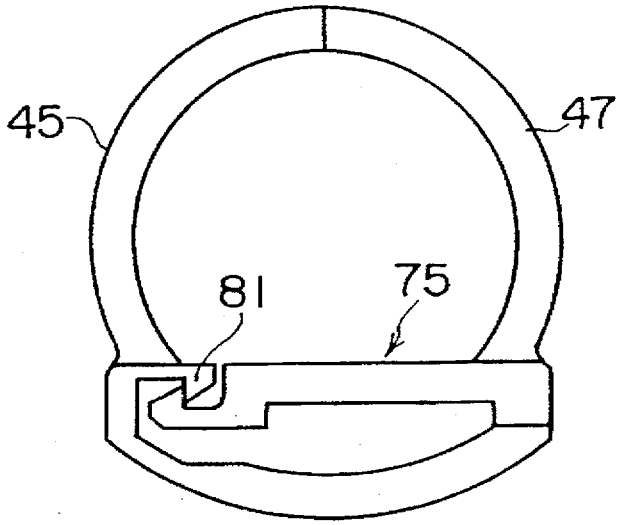
FIG. 10 is an end view of lock members according to the invention.
Figure 17:
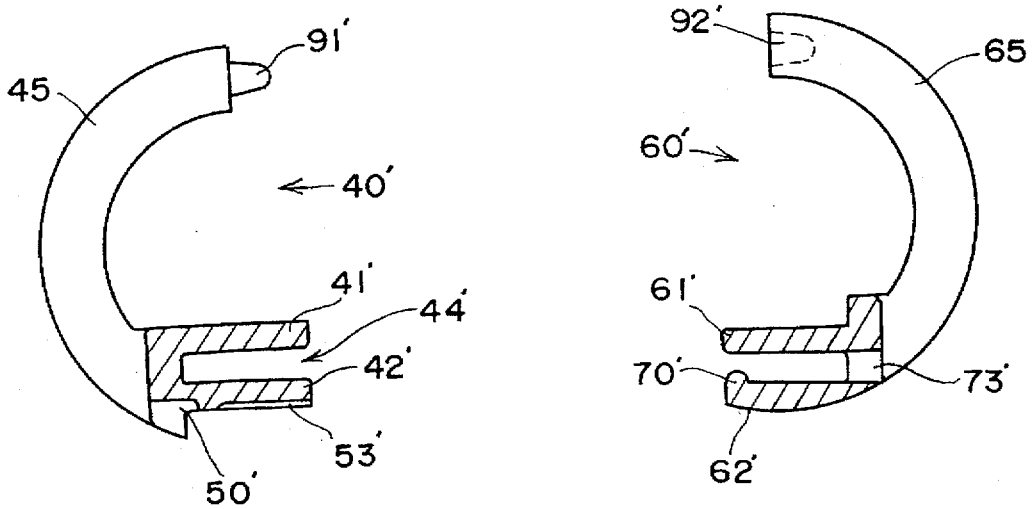
FIG. 17 is a sectional view taken along the line F—F of FIG. 14.

A preferred embodiment of the invention will now be described in detail with reference to FIGS. 5 through 10. As shown in FIG. 5, the loose-leaf binder according to this invention is made up of a first back strip 41 on which there are formed a plurality of split ring halves 45 upright at regular intervals along the outer edge of the strip and a second back strip 43 on which there are formed a plurality of split ring halves 47 adapted to engage with the ring halves 45, upright along the outer edge opposite to the edge of the first strip 41. For the split ring halves 45, 47, those of any known design may be used. For example, they may be rectangular in cross section as illustrated in FIG. 5 and may be serrated at the upper end in mutually complementary fashion, as in FIG. 9, to mesh with each other or, alternatively, they may be round in cross section like the ring halves 45, 65 of FIG. 17 and similarly have a small protuberance 91' and a corresponding recess 92' on opposing ends. The binding ring halves 45 of the first back strip are formed on a thick-walled outer edge portion 49. The first and second back strips are of a separable type that can be completely separated from the combined state. The two strips can be put together or separated when loose leaves have to be bound or removed, in the manner to be described later.

The first back strip 41 has a sliding surface 51 on the top, the outer edge of which constitutes the bottom of an undercut 53 formed in the thick-walled portion 49. The second back strip 43 has a sliding surface 55 on the bottom, which comes in sliding contact with the sliding surface 51 of the first back strip 41. The inner edge of the second back strip 43 is formed with a thinwalled extension 57 which closely fits in the undercut 53 of the first back strip 41. This ensures integral stability of the two back strips as well as accurate vertical alignment of the split rings when the strips are united to close the split ring halves together. This device too is well known in the art.

To make the back strips 41, 43 easier to combine and assure more exact alignment of the split rings, in accordance with the characteristics of the present invention, there are formed a first guide 59 and a second guide 61 on the respective strips, the both guides extending substantially at right angles to the longitudinal directions of the strips and shaped complementary to each other. Depending on the length of the back strips, the guides 59, 61 may be provided at a plurality of points rather than at a single point along the axial direction of the strips. The first guide 59 consists of a guide rib 63 extending transversely to the longitudinal direction of the first back strip and a flap 65 slightly tapering toward the free end. The second guide 61 consists of a guide slit 67 which slidingly receives the guide rib 63 of the first guide 59 and a planar recess 71 to receive the flap 65. The recess 71 is slightly tapered inwardly matched with the contour of the flap 65. The guide rib 63 and the guide slit 67 may loosely fit to each other, since the accurate alignment of the two back strips is governed by the tapers of the flap 65 and the recess 71 in complete engagement.

While the guide arrangement just described is a preferred one, some other appropriate guide structure may be adopted instead. For example, the guide rib 63 and the corresponding slit 67 may be omitted with some functional sacrifice. Conversely the flap 65 and the recess 71 may be eliminated by tapering both the guide rib 63 and the slit 67.

Under the invention, in order that the two back strips 41, 43 can be securely locked together when they are put together to close their split rings and that they can also be unlocked when the occasion demands, the back strips 41, 43 are provided, respectively, with a first lock member 73 and a second lock member 75 at each ends (the both ends of the strips being symmetrical in structure, only the mating parts at one ends are shown). The first lock member 73 consists of a recess 77 formed in the sliding surface of the first back strip and a hook 81 protruding downwardly from the underside of the thick-walled portion 49 toward an undercut 79. The second lock member 75 consists of an elastic lever 83 extending from the inner side of the second back strip 43 toward the undercut 79 and a hook 85 formed at the front end of the lever to engage with the hook 81. The elastic lever 83 is designed to undergo elastic deformation without contacting the bottom of the recess 77. The extremities of the hooks 81, 85 are tapered so that when the two lock members are closed the hook 85 can slide naturally to the lock position by the cam action of those tapers. It is possible to reduce the dimension d between the free end of the recess 77 and the side wall 78 defining the recess gradually from right to left as viewed in FIG. 5, so that the right end 86 of the hook 85 comes in precise contact with the leftmost end of the side wall 78. The lock members then will attain guide action in themselves and make the guides 59, 61 no longer necessary. When the back strips are long it is desirable to provide one or more sets of guides at intermediate and other appropriate points axially of the strips, regardless of whether the guide function is imparted to the lock members. A serrated mark 87 may be put to the part to be pressed down by the thumb for unlocking. The lock members so far described make use of the basic configurations of the two back strips, and therefore are extremely simple in structure, small and thin.

The construction described above permits the lock members 73, 75 to be automatically engaged when the two back strips are forced against each other. Depressing the second lock member unfastens the lock against the elastic recovery of the lever 83. The lock members, formed as part of the both back strips, can be made small enough to save space.

Where necessary, the first back strip may have perforations for fasteners so that it can be attached to a cover. Thus, while the binder of the invention is particularly suited for coverless applications, it is readily adapted for use with a cover.

In the construction described, the split ring halves 45, 47 are closed together in the following manner. First, the two back strips are arranged generally in parallel, the sliding surface 55 of the second back strip 43 is placed on the sliding surface 51 of the first back strip 41, and then the guide rib 63 is fitted into the guide slit 67. Since the two guide means are designed to fit loosely, they can be easily groped for mutual engagement. The two back strips 41, 43 are forced farther toward each other (at right angles to the longitudinal directions of the strips). The engagement of the tapered flap 65 with the correspondingly tapered recess 71 sets the two back strips in exact longitudinal position relative to each other. Also, the intimate fitting of the thin-walled extension 57 of the second back strip into the undercut 53 of the first back strip 41 ensures accurate vertical arrangement of the two back strips. Consequently, the split ring halves are exactly aligned and connected end to end. At the same time, the lock members 73, 75 are automatically engaged as they are led along the tapered planes of the hooks 81, 85 to the locking position. To release the lock members from the locking position, the parts are caused to slide apart horizontally while the mark 87 in FIG. 5 is being depressed.

In other cases, as when the first and second back strips are short enough, the guide parts need not be provided.

Second Embodiment

Figure 11:
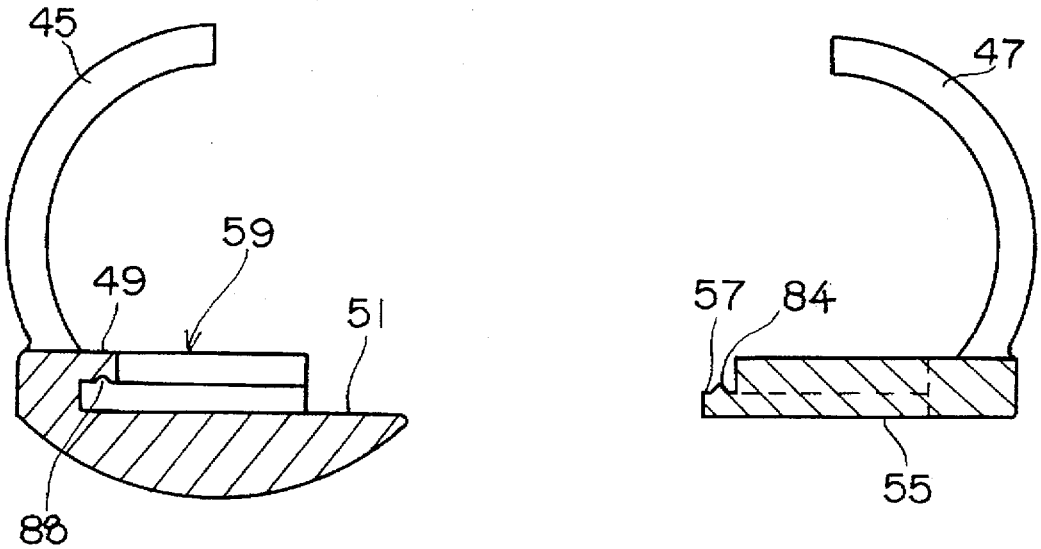
FIG. 11 is a sectional view of detent means according to the invention.

When the first and second back strips are long, it is possible, as shown in FIG. 11, to form a small rib 84 as a detent on one back strip and a corresponding groove 88 on the other back strip for mutual engagement. This precludes the possibility of the back strips with the closed rings being forced apart midway under the burden of loose leaves.

Third Embodiment

Figure 12:
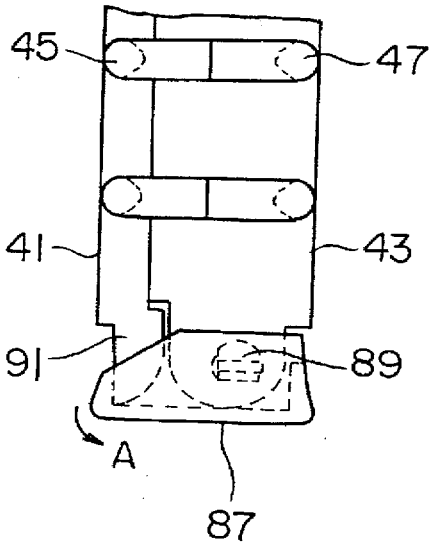
FIG. 12 is a plan view showing another lock structure according to the invention.

Another lock structure, such as indicated in FIG. 12, may be employed. Here a movable lock member 87 is pivotally connected to the second back strip through a spring-loaded pivot 89. It catches a fixed lock member 91 on the first back strip 41. The movable lock member is turned in the direction of the arrow A to unlock and is turned in the reverse direction for locking.

Fourth Embodiment

Figure 13:
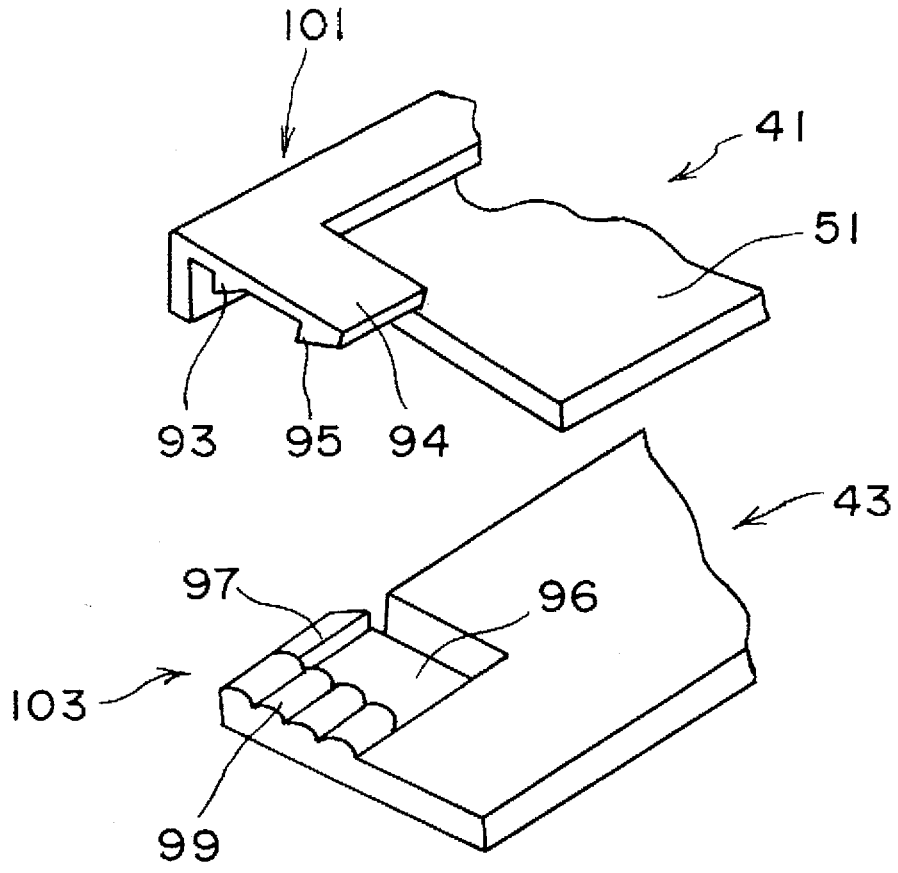
FIG. 13 is a perspective view of another example of the lock according to the invention.

In still another modification, the lock members may be provided for two-step locking, so that the two back strips can be slid apart to split the rings open to a certain degree. FIG. 13 illustrates such two-step lock means that can replace the set of lock members 73, 75 in FIG. 5. As shown, the first back strip 41 and the second back strip 43 are provided at both ends (only one ends being shown) with a first lock member 101 and a second lock member 103, respectively. The first lock member 101 comprises a tongue 94 extending in the direction where split rings are opened or closed (i.e., the direction in which the two back strips are slid toward or away from each other) and a pair of hooks 93, 95 protruding downwardly from the underside of the tongue. The second lock member 103 comprises a leaf 96 that constitutes a spring, a hook 97 formed at the free end of the leaf, and a thumb presser 99 formed in one piece with the leaf and adapted to be depressed by the thumb. When the hook 97 is meshed with the hook 93, the split ring halves are elastically fitted together, and when the hook 97 is meshed with the hook 95, the rings are split open but the two back strips are still engaged. In operation, when the rings are closed, the lever 99 is pressed down and forced rightward as viewed in FIG. 13 while, at the same time, the downward force is lessened. Then, the hook 97 comes in mesh with the hook 95. If the two back strips are to be completely separated, the presser is depressed and forced farther rightward.

Fifth Embodiment

Figure 14:
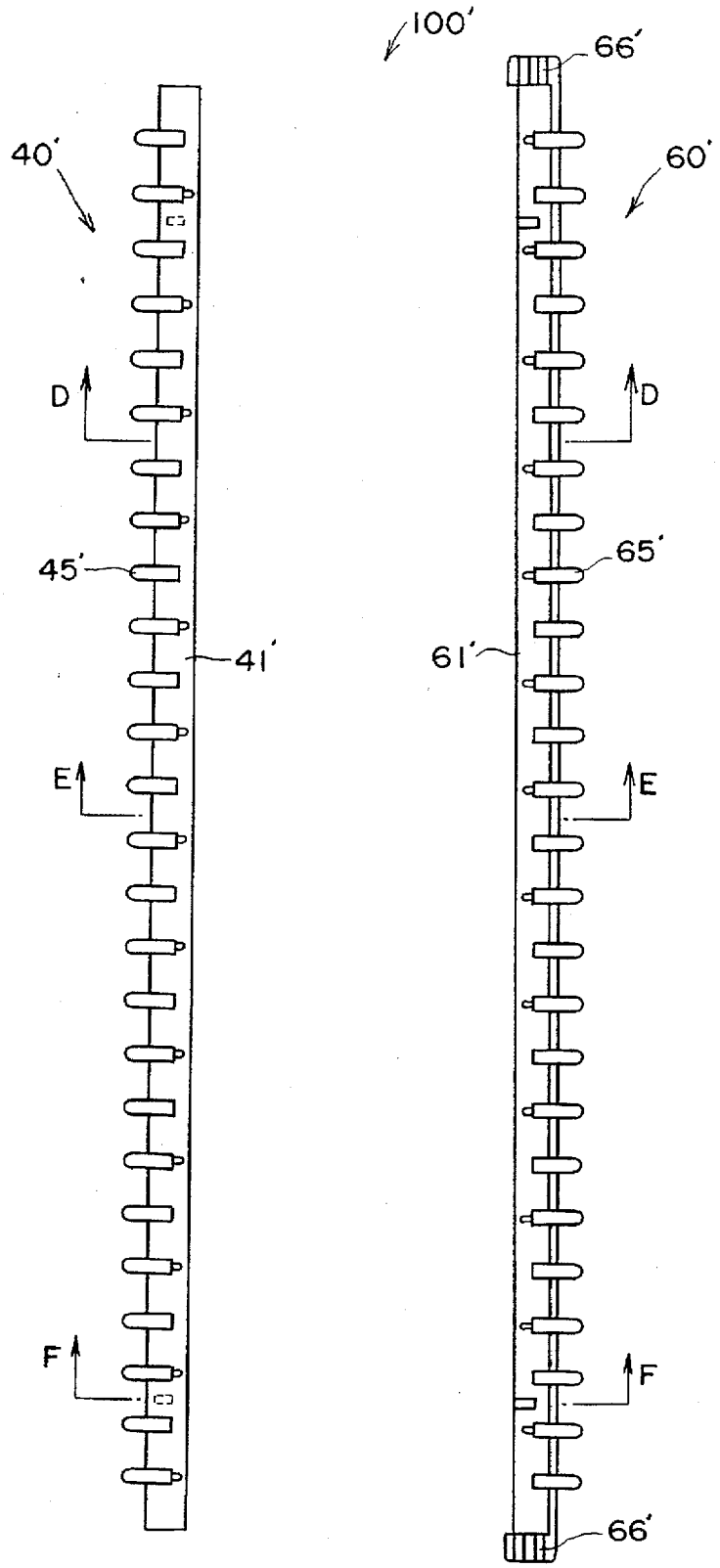
FIG. 14 is a plan view of another embodiment of the binder of the invention, as put together.
Figure 15:
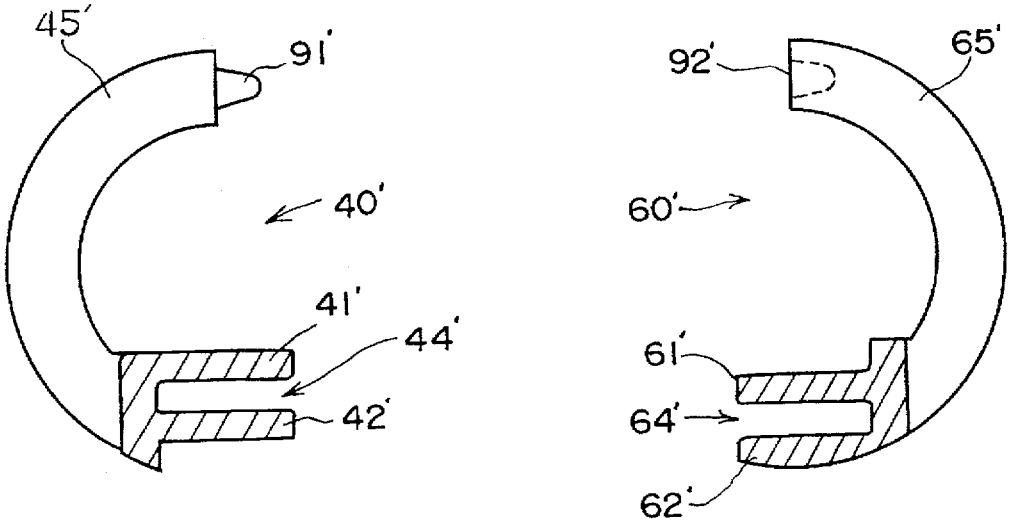
FIG. 15 is a sectional view taken along the line D—D of FIG. 14.
Figure 16:
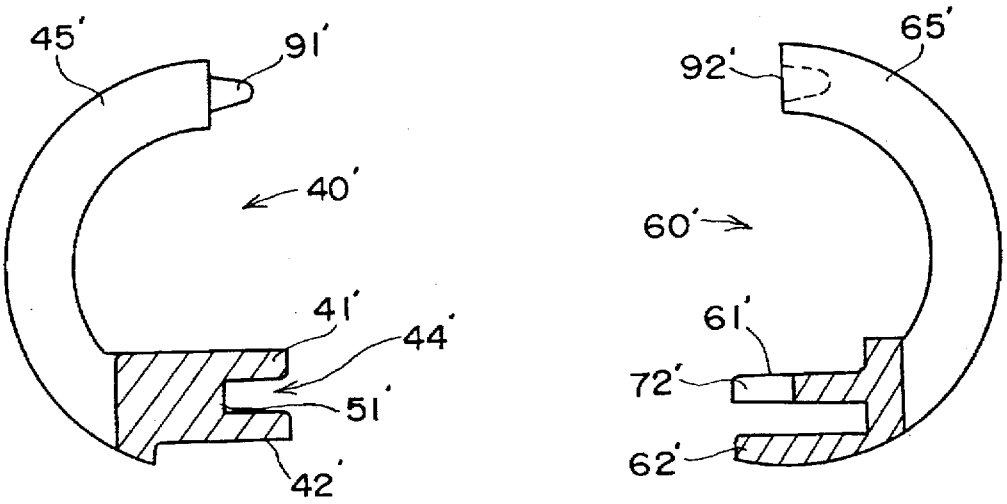
FIG. 16 is a sectional view taken along the line E—E of FIG. 14.

Another embodiment of the present invention is illustrated in FIGS. 14 to 17. The first back strip 40' comprises a first upper flap 41' above an insertion flap 42', defining a recess 44' in between, into which a second upper flap 61' can be inserted. In order to maintain the depth of the recess 44', it is desirable to form an upright support 51' in the recess 44' formed in the first back strip 40' and form a recess 72' in the second upper flap 61' to receive the support 51'. As shown in FIGS. 15 and 16, insertion flap 42' and recess 64' each have a substantially uniform cross-sectional thickness. Provision of lockable thumb levers 66' as shown in FIG. 14 on the both ends of the second back strip 60', in the same direction or on the right side as viewed at the near end, makes it easier to disconnect the engaged binder halves from each other.

To close the pairs of split ring halves 45', 65' into ring form, the user holds the two binder halves side by side, with catching protuberances 70' aligned to corresponding guide slots 53', fits the insertion flap 42' into the recess 64' until the protuberances 70' rest in corresponding recesses 50'. Conversely closed ring halves 45' and 65' are split open by depressing the thumb levers 66' to unlock and then forcing them sidewise, disengaging the detents 50', 70' and further forcing the two back strips apart.

The binder according to this invention consists only of two separate components and is very simple in construction; it can be made by injection molding of plastics easily and inexpensively. The split binder rings can be readily closed and locked by simply putting the two back strips together. The lock members are not exposed to the outside and virtually form a part of the back strips. The binder therefore is thin enough to be used without a cover. From its appearance the inclusion of lock means is practically unnoticeable. The guides in accordance with the invention have simply to serve rectilinear guiding purposes. No complex guide mechanism of the prior art is necessary.

The use of detents with guides prevents loose leaves from being caught between loosened split rings midway on long back strips.

Provision of locks in two steps permits the split rings to be opened or closed without disconnection of their back strips.

Further, either back strip may be formed with a recess and the other back strip with an insertion flap so that they fit together, or both back strips may be formed with a recess to receive an insertion flap or upper or lower flap of the opposite strips. In either case, the frictional forces of the engaging parts can be utilized in supplementing the forces with which the locks make the binder fast and assisting in the alignment of the split rings.

What is claimed is:

1. A loose-leaf binder comprising, in combination, a first back strip having a plurality of split ring halves formed upright at given intervals along the outer edge thereof and a second back strip having similar ring halves formed along the outer edge thereof opposite to that of the first strip and adapted to engage end to end with the halves of the first strip, said first and second back strips being formed as discrete members separable from the combined state and having, respectively, a first and a second sliding surfaces slidable relative to each other, a first and a second guides extending substantially at right angles to the longitudinal directions of the two strips and formed to shapes complementary to each other so as to guide the sliding surfaces, and a first and a second lock members in such manner that said lock members can engage with each other when the two strips are put together in the closed position.

2. The binder of claim 1 wherein the first sliding surface is formed on the top of the first back strip and the second sliding surface on the bottom of the second back strip.

3. The binder of claim 1 wherein the first back strip has, as a first guide, a guide rib extending along the first sliding surface and substantially at right angles to the longitudinal direction of the strip and the second back strip has, as a second guide, a guide slit which slidingly receives the guide rib for engagement.

4. The binder of claim 1 wherein the first lock member includes a hook protruding downwardly from each end of the first back strip and the second lock member includes a hook formed at each end of the second back strip to engage with said hook of the first strip.

5. The binder of claim 1 wherein the first lock member includes a pair of first hooks protruding downwardly from each end of the first back strip and arranged in tandem in the direction where the two back strips are slid toward or away from each other and the second lock member includes a hook formed at each end of the second back strip to engage with either of said hooks of the first strip.

6. The binder of claim 1 wherein the first and second back strips are provided, respectively, with a rib as a detent and a corresponding groove for mutual engagement at an intermediate point of the strips.

7. The binder of claim 1 wherein either of the first and second back strips has an insertion flap and the other strip has an upper flap and a lower flap defining a recess in between, into which said insertion flap can be fitly inserted.

8. The binder of claim 1 wherein either of the first and second back strips has an insertion flap an a contact flap formed above or below and in parallel with the insertion flap and the other strip has an upper flap and a second flap defining a groove in which said insertion flap is fitly inserted, said contact flap being adapted to come into intimate contact with one side of said upper or lower flap.

9. The binder of claim 2 wherein the first back strip has, as a first guide, a guide rib extending along the first sliding surface and substantially at right angles to the longitudinal direction of the strip and the second back strip has, as a second guide, a guide slit which slidingly receives the guide rib for engagement.

10. The binder of claim 2 wherein the first lock member includes a hook protruding downwardly from each end of the first back strip and the second lock member includes a hook formed at each end of the second back strip to engage with said hook of the first strip.

11. The binder of claim 3 wherein the first lock member includes a hook protruding downwardly from each end of the first back strip and the second lock member includes a hook formed at each end of the second back strip to engage with said hook of the first strip.

12. The binder of claim 2 wherein the first lock member includes a pair of first hooks protruding downwardly from each end of the first back strip and arranged in tandem in the direction where the two back strips are slid toward or away from each other and the second lock member includes a hook formed at each end of the second back strip to engage with either of said hooks of the first strip.

13. The binder of claim 3 wherein the first lock member includes a pair of first hooks protruding downwardly from each end of the first back strip and arranged in tandem in the direction where the two back strips are slid toward or away from each other and the second lock member includes a hook formed at each end of the second back strip to engage with either of said hooks of the first strip.

14. The binder of claim 2 wherein the first and second back strips are provided, respectively, with a rib as a detent and a corresponding groove for mutual engagement at an intermediate point of the strips.

15. The binder of claim 3 wherein the first and second back strips are provided, respectively, with a rib as a detent and a corresponding groove for mutual engagement at an intermediate point of the strips.

16. The binder of claim 4 wherein the first and second back strips are provided, respectively, with a rib as a detent and a corresponding groove for mutual engagement at an intermediate point of the strips.

17. The binder of claim 5 wherein the first and second back strips are provided, respectively, with a rib as a detent and a corresponding groove for mutual engagement at an intermediate point of the strips.

18. The binder of claim 2 wherein either of the first and second back strips has an insertion flap and the other strip has an upper flap and a lower flap defining a recess in between, into which said insertion flap can be fitly inserted.

19. The binder of claim 3 wherein either of the first and second back strips has an insertion flap and the other strip has an upper flap and a lower flap defining a recess in between, into which said insertion flap can be fitly inserted.

20. The binder of claim 4 wherein either of the first and second back strips has an insertion flap and the other strip has an upper flap and a lower flap defining a recess in between, into which said insertion flap can be fitly inserted.

21. The binder of claim 5 wherein either of the first and second back strips has an insertion flap and the other strip has an upper flap and a lower flap defining a recess in between, into which said insertion flap can be fitly inserted.

22. The binder of claim 6 wherein either of the first and second back strips has an insertion flap and the other strip has an upper flap and a lower flap defining a recess in between, into which said insertion flap can be fitly inserted.

23. The binder of claim 2 wherein either of the first and second back strips has an insertion flap an a contact flap formed above or below and in parallel with the insertion flap and the other strip has an upper flap and a second flap defining a groove in which said insertion flap is fitly inserted, said contact flap being adapted to come into intimate contact with one side of said upper or lower flap.

24. The binder of claim 3 wherein either of the first and second back strips has an insertion flap an a contact flap formed above or below and in parallel with the insertion flap and the other strip has an upper flap and a second flap defining a groove in which said insertion flap is fitly inserted, said contact flap being adapted to come into intimate contact with one side of said upper or lower flap.

25. The binder of claim 4 wherein either of the first and second back strips has an insertion flap an a contact flap formed above or below and in parallel with the insertion flap and the other strip has an upper flap and a second flap defining a groove in which said insertion flap is fitly inserted, said contact flap being adapted to come into intimate contact with one side of said upper or lower flap.

26. The binder of claim 5 wherein either of the first and second back strips has an insertion flap an a contact flap formed above or below and in parallel with the insertion flap and the other strip has an upper flap and a second flap defining a groove in which said insertion flap is fitly inserted, said contact flap being adapted to come into intimate contact with one side of said upper or lower flap.

27. The binder of claim 6 wherein either of the first and second back strips has an insertion flap an a contact flap formed above or below and in parallel with the insertion flap and the other strip has an upper flap and a second flap defining a groove in which said insertion flap is fitly inserted, said contact flap being adapted to come into intimate contact with one side of said upper or lower flap.

28. A loose-leaf binder comprising: a first back strip having a plurality of split ring halves formed upright at given intervals along the outer edge thereof and a second back strip having similar ring halves formed along the outer edge thereof opposite to the outer edge of the first strip and adapted to engage end-to-end with the ring halves of the first strip, said first and second back strips being formed as discrete members which are separable from each other, one of the first and second back strips having an insertion flap, the other of the first and second back strip having an upper flap and a lower flap defining a recess therebetween into which said insertion flap can be fittingly inserted into frictional engagement, the insertion flap and the recess each having a substantially uniform thickness.

29. A loose-leaf binder comprising: a first back strip having a plurality of split ring halves formed upright at given intervals along the outer edge thereof and a second back strip having similar ring halves formed along the outer edge thereof opposite to the outer edge of the first strip and adapted to engage end-to-end with the ring halves of the first strip, said first and second back strips being formed as discrete members which are separable from each other, one of the first and second back strips having an insertion flap and a contact flap formed below and in parallel with the insertion flap, the other of the first and second back strips having an upper flap and a lower flap defining a groove in which said insertion flap is fittingly inserted into frictional engagement, said contact flap being adapted to come into intimate contact with the lower side of said lower flap, the insertion flap and the groove each having a substantially uniform thickness.

30. The binder of claim 28, wherein one of the first and second back strips are provided with a detent rib and the other of the first and second back strips is provided with a corresponding groove for mutual engagement at an intermediate point of the strip.

31. The binder of claim 29, wherein one of the first and second back strips are provided with a detent rib and the other of the first and second back strips is provided with a corresponding groove for mutual engagement at an intermediate point of the strip.

* * * * *